US006732391B2

(12) United States Patent
George, II

(10) Patent No.: US 6,732,391 B2
(45) Date of Patent: May 11, 2004

(54) FRAMELESS CHAIR

(75) Inventor: Daniel C. George, II, Grand Rapids, MI (US)

(73) Assignee: Comfort Research, LLC, Grand Rapids, MI (US)

( * ) Notice: Subject to any disclaimer, the term of this patent is extended or adjusted under 35 U.S.C. 154(b) by 72 days.

(21) Appl. No.: 09/973,416

(22) Filed: Oct. 9, 2001

(65) Prior Publication Data

US 2002/0078508 A1 Jun. 27, 2002

Related U.S. Application Data

(63) Continuation-in-part of application No. 09/941,064, filed on Aug. 28, 2001, which is a continuation of application No. 09/372,369, filed on Aug. 11, 1999, now Pat. No. 6,279,184.

(51) Int. Cl.[7] ..... A47C 20/02
(52) U.S. Cl. ..... 5/652; 5/655.9
(58) Field of Search ..... D6/349, 351, 352, D6/355; 5/652, 655.9, 632, 648

(56) References Cited

U.S. PATENT DOCUMENTS

| | | | | | |
|---|---|---|---|---|---|
| D153,191 | S | * | 3/1949 | Walters | D6/335 |
| 3,965,506 | A | | 6/1976 | Marks | |
| 3,992,733 | A | | 11/1976 | Racine | |
| 4,184,237 | A | * | 1/1980 | Blankenship | 29/91.1 |
| 5,106,884 | A | | 4/1992 | Turner et al. | |
| 5,265,295 | A | * | 11/1993 | Sturgis | 5/655.9 |
| 5,566,953 | A | | 10/1996 | Arriola et al. | |
| D384,211 | S | | 9/1997 | Wied et al. | |
| 5,813,932 | A | | 9/1998 | Grafton | |
| 6,141,807 | A | | 11/2000 | Tapper | |

* cited by examiner

*Primary Examiner*—Teri Pham Luu
*Assistant Examiner*—Fredrick Conley
(74) *Attorney, Agent, or Firm*—King & Jovanovic, PLC

(57) ABSTRACT

A frameless chair comprising: a flexible, substantially spherical outer liner, wherein the outer liner is at least partially gas permeable, and a plurality of polyurethane foam pieces retained within the outer liner.

4 Claims, 19 Drawing Sheets

FRAMELESS CHAIR

CROSS-REFERENCE TO RELATED APPLICATION(S)

This application is a continuation-in-part of co-pending U.S. application Ser. No. 09/941,064, filed on Aug. 28, 2001, which is a continuation application of Ser. No. 09/372,369 filed on Aug. 11, 1999, now U.S. Pat. No. 6,279,184, the entirely of which are hereby incorporated herein by reference.

BACKGROUND OF THE INVENTION

1. Field of the Invention

The present invention relates in general to frameless chairs, and more particularly, to a frameless chair having a structural configuration which, among other things, increases longevity, durability, washability, and shapability of the same.

2. Background Art

Frameless chairs have been known in the art for several years. Furthermore, frameless chairs filled with beads of polystyrene foam have likewise been known in the art. While such conventional frameless chairs have become popular, their shapability and durability, among other things, remains largely problematic. In particular, after a conventional frameless chair has been occupied by a person, the beads of polystyrene foam which are held within the liner of the chair result in the chair having depression where the person was sitting. The depression remains in the chair unless and until a person reshapes the chair by exerting physical force upon it—such as by rolling, shaking, or fluffing the chair.

A second problem associated with conventional frameless chairs is that once the outer liner of the chair has been worn through by normal wear and tear or otherwise damaged by accidental puncturing, the beads of polystyrene foam are readily released from the chair and, in turn, can endanger, for example, small children and/or animals. Moreover, inasmuch as conventional chairs have only one liner, washing such a liner is extremely difficult because the numerous beads of polystyrene foam must first be removed before the liner can be machine washed. In addition, conventional frameless chairs have material and stitching patterns that are not conducive to promoting chair longevity. Specifically, for example, the stitching used in conventional frameless chairs is externally exposed making it vulnerable to "catching" and/or "snagging" by an occupant.

SUMMARY OF THE INVENTION

The present invention is directed to a frameless chair comprising: (a) a unitary outer liner, wherein the unitary outer liner is flexible and at least partially gas permeable, and further wherein the unitary outer liner comprises two substantially circular lobes which emanate contiguously from opposite ends of a regular or non-regular polygonal member, and further wherein the two substantially circular lobes are secured to each other to, in turn, form a substantially spherical outer liner; and (b) a plurality of polyurethane foam pieces retained within the outer liner.

In a preferred embodiment of the present invention, the regular or non-regular polygonal member may comprise a substantially rectangular member.

The present invention is also directed to a frameless chair comprising: (a) a unitary outer liner, wherein the unitary outer liner is flexible and at least partially gas permeable, and further wherein the unitary outer liner comprises two substantially circular lobes which emanate contiguously from opposite ends of a regular or non-regular polygonal member, and further wherein the two substantially circular lobes are secured to the regular or non-regular polygonal member to, in turn, form a substantially spherical outer liner; and (b) a plurality of polyurethane foam pieces retained within the outer liner.

The present invention is further directed to a frameless chair comprising: (a) an outer liner, wherein the outer liner is at least partially gas permeable, and further wherein the outer liner comprises: (1) a first flexible component having a substantially lemniscate peripheral geometry; and (2) a second flexible component having a substantially lemniscate peripheral geometry, wherein the first flexible component is secured to the second flexible component to, in turn, form a substantially spherical outer liner; and (b) a plurality of polyurethane foam pieces retained within the outer liner.

In accordance with the present invention a frameless chair is disclosed as comprising: (a) an outer liner, wherein the outer liner is at least partially gas permeable, and further wherein the outer liner comprises: (1) a first flexible component having a substantially circular peripheral geometry; and (2) a second flexible component having a substantially circular peripheral geometry, wherein the first flexible component is secured to the second flexible component to, in turn, form a substantially spherical outer liner; and (b) a plurality of polyurethane foam pieces retained within the outer liner.

The present invention is also directed to a frameless chair comprising: (a) an outer liner, wherein the outer liner is at least partially gas permeable, and further wherein the outer liner comprises: (1) a first flexible component having a substantially biconvex peripheral geometry; (2) a second flexible component having a substantially biconvex peripheral geometry; and (3) a third flexible component having a substantially biconvex peripheral geometry, wherein the first flexible component is secured to the second flexible component, and wherein the second flexible component is secured to the third flexible component, and further wherein the third flexible component is secured to the first flexible component to, in turn, form a substantially spherical outer liner; and (b) a plurality of polyurethane foam pieces retained within the outer liner.

The present invention is further directed to a frameless chair comprising: (a) an outer liner, wherein the outer liner is at least partially gas permeable, and further wherein the outer liner comprises at least three flexible components having a substantially biconvex peripheral geometry, and further wherein each one of the at least three flexible components is secured to two others of the at least three flexible components to, in turn, form a substantially spherical outer liner; and (b) a plurality of polyurethane foam pieces retained within the outer liner.

In accordance with the present invention a frameless chair is disclosed as comprising: (a) an outer liner, wherein the outer liner is at least partially gas permeable, and further wherein the outer liner comprises four flexible components having a substantially pyriform peripheral geometry, and further wherein the four flexible components are secured to each other to, in turn, form a substantially spherical outer liner; and (b) a plurality of polyurethane foam pieces retained within the outer liner.

The present invention is further directed to a frameless chair comprising: (a) an outer liner, wherein the outer liner is at least partially gas permeable, and further wherein the outer liner comprises eight flexible components having a substantially hemipyriform peripheral geometry, and further wherein the eight flexible components are secured together to, in turn, form a substantially spherical outer liner; and (b) a plurality of polyurethane foam pieces retained within the outer liner.

Moreover, the present invention is directed to a frameless chair comprising: (a) a unitary outer liner, wherein the unitary outer liner is flexible and at least partially gas permeable, and further wherein the unitary outer liner comprises an unassembled outer peripheral geometry represented by the structure of the outer liner provided in FIG. 6A, FIG. 6B, FIG. 8A, or FIG. 8B; and (b) a plurality of polyurethane foam pieces retained within the outer liner.

The present invention is also directed to a frameless chair comprising: (a) an outer liner, wherein the outer liner is at least partially gas permeable, and further wherein the outer liner comprises two flexible components comprising outer peripheral geometries represented by the structures of the members of the outer liner provided in FIG. 10A, FIG. 10B, or FIG. 12; and (b) a plurality of polyurethane foam pieces retained within the outer liner.

The present invention is further directed to a frameless chair comprising: (a) an outer liner, wherein the outer liner is at least partially gas permeable, and further wherein the outer liner comprises at least three flexible components comprising outer peripheral geometries represented by the structures of the members of the outer liner provided in FIG. 14; and (b) a plurality of polyurethane foam pieces retained within the outer liner.

Furthermore, the present invention is directed to a frameless chair comprising: (a) an outer liner, wherein the outer liner is at least partially gas permeable, and further wherein the outer liner comprises four flexible components comprising outer peripheral geometries represented by the structures of the members of the outer liner provided in FIG. 16; and (b) a plurality of polyurethane foam pieces retained within the outer liner.

The present invention is directed to a frameless chair comprising: (a) an outer liner, wherein the outer liner is at least partially gas permeable, and further wherein the outer liner comprises eight flexible components comprising outer peripheral geometries represented by the structures of the members of the outer liner provided in FIG. 18; and (b) a plurality of polyurethane foam pieces retained within the outer liner.

In a preferred embodiment of the present invention, the frameless chair further comprises an inner liner positioned within the outer liner, wherein the plurality of polyurethane pieces are retained within the inner liner.

In another preferred embodiment of the present invention, the frameless chair further comprises a looped handle.

Preferably, the density of the polyurethane foam pieces ranges from between approximately 1.0 and approximately 4.0 pounds per cubic foot.

In a preferred embodiment of the present invention, the outer liner includes at least one seam having an outer surface and an inner surface, wherein the outer surface of the seam is void of any exposed stitching.

BRIEF DESCRIPTION OF THE DRAWINGS

The invention will now be described with reference to the drawings wherein.

DETAILED DESCRIPTION OF THE DRAWINGS

Figure 1:
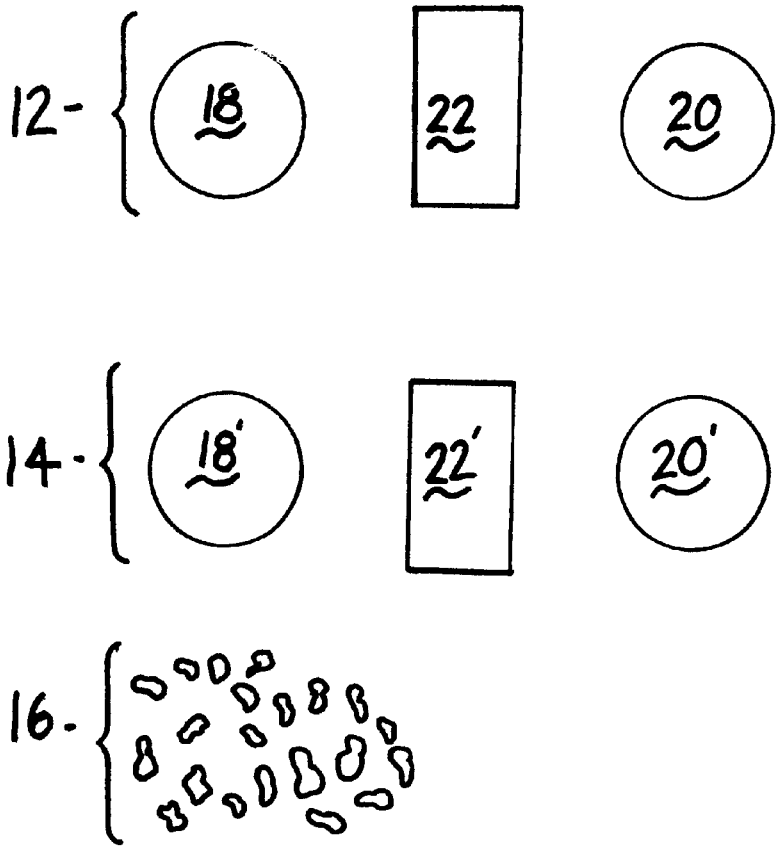
FIG. 1 of the drawings is a schematic representation of an unassembled frameless chair according to the present invention.

While this invention is susceptible of embodiment in many different forms, there is shown in the drawings and will herein be described in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings with like reference characters. It will further be understood that FIGS. 1–19 are merely schematic representations. As such, some of the components may be distorted from their actual scale for pictorial clarity. Moreover, while drawings of frameless chair 10 may not appear substantially spherical, frameless chair 10 will take on a substantially spherical geometry upon filling with a plurality of polyurethane foam pieces.

Frameless chair 10 is shown in FIG. 1, prior to assembly, as generally comprising outer liner 12, inner liner 14, and a plurality of polyurethane foam pieces 16.

Outer liner 12 includes first end component 18, second end component 20, and intermediate component 22. First and second end components 18 and 20 have a substantially circular peripheral geometry and intermediate component 22 has a substantially rectangular peripheral geometry. Upon assembly of outer liner 12, first and second end components 18 and 20 and intermediate component 22 are fused together, preferably by sewing. However, any one of a number of fusing techniques known to those having ordinary skill in the art are likewise contemplated for use.

Figure 2:
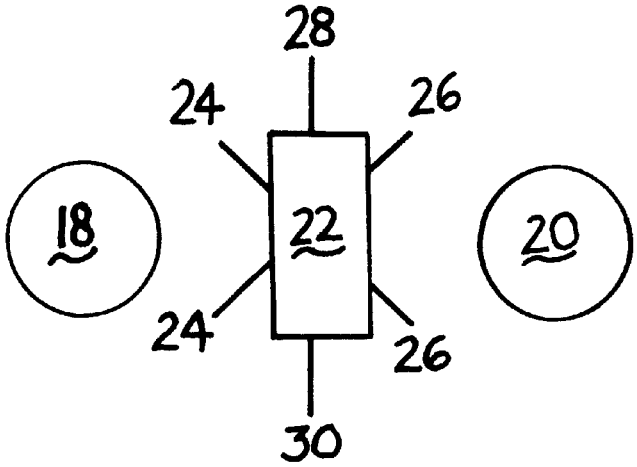
FIG. 2 of the drawings is a schematic representation of an unassembled outer liner showing the adjoining edges of the component parts according to the present invention.
Figure 3:
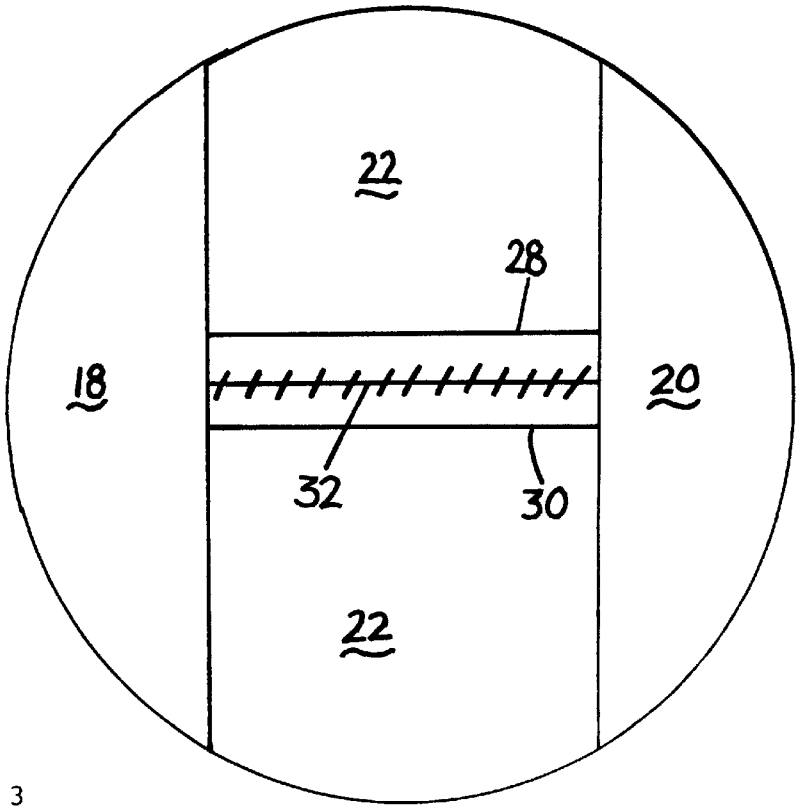
FIG. 3 of the drawings is a schematic representation of an assembled outer liner showing the placement of a zipper according to the present invention.

As is best shown in FIG. 2, the peripheral edge of end component 18 is fused to edge 24 of intermediate component 22 and the peripheral edge of end component 20 is fused to edge 26 of intermediate component 22. Edges 28 and 30 of intermediate component 22 are fused together to, in turn, form a three piece substantially spherical outer liner. It will be understood that the configurations disclosed herein are simple to cut (or even stamp) and stitch making them highly desirous. As is shown in FIG. 3, zipper 32 is preferably fused between edges 28 and 30. However, it is also contemplated that zipper 32 can be associated with either first and/or second end components 18 and 20, respectively. In addition, zipper 32 can be treated with an adhesive to enhance the lockability of zipper and, in turn, substantially prevent zipper 32 from opening inadvertently.

Figure 4:
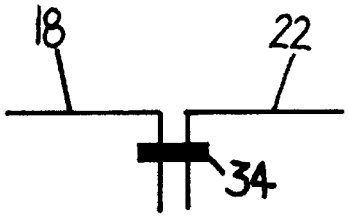
FIG. 4 of the drawings is a fragmented cross sectional schematic representation of an outer liner showing a stitch location according to the present invention.
Figure 5:
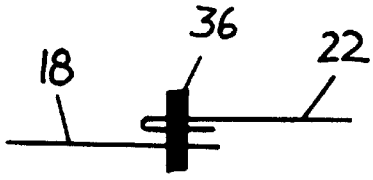
Figure 5 Prior Art
FIG. 5 of the drawings is a fragmented cross sectional schematic representation of a prior art outer liner showing the stitch location.

Components 18, 20, and 22 of outer liner 12 are preferably sewn together so that the external seams are void of exposed stitching. The avoidance of exposed stitching is best shown in FIG. 4 and accomplished by, for example, mating components 18 and 22 without overlapping the material and sewing at least one stitch at point 34. As is shown in FIG. 5, if components 18 and 22 are conventionally overlapped and sewn at point 36, a stitch is exposed to the outer surface of outer liner 12, which is vulnerable to catching or snagging. Components 18, 20 and 22 of outer liner 12 are preferably fabricated from a machine washable, flexible material and/or fabric that is at least partially gas permeable—so as to allow air to enter and exit the liner when an occupant sits in or departs from the chair. For example, the outer liners disclosed herein may comprise natural and/or synthetic materials, including, but not limited to, wool, leather, denim, cotton, polyester, etcetera.

Referring again to FIG. 1, inner liner 14 includes first end component 18', second end component 20', and intermediate component 22'. First and second end components 18' and 20' have substantially circular peripheral geometry and intermediate component 22' has a substantially rectangular peripheral geometry. First and second end components 18' and 20' and intermediate component 22' are fused together, preferably by sewing, in an analogous manner as previously described relative to outer liner 12 to form a substantially spherical inner liner. Preferably a zipper, similar to zipper 32, is associated with either one or both of first and second end components 18' and 20', respectively. Components 18', 20' and 22' of inner liner 14 are preferably fabricated from a machine washable, flexible material that is at least partially gas permeable.

Once inner liner 14 is fabricated, a plurality of polyurethane pieces 16 are inserted into inner liner 14 to, in turn, fill out the substantially spherical space. Inner liner 14 is then fitted into outer liner 12 to complete assembly. It will be understood that frameless chair 10 can be fabricated without inner liner 14. In such a case, polyurethane foam pieces 16 are inserted directly into the outer liner.

Figure 6A:
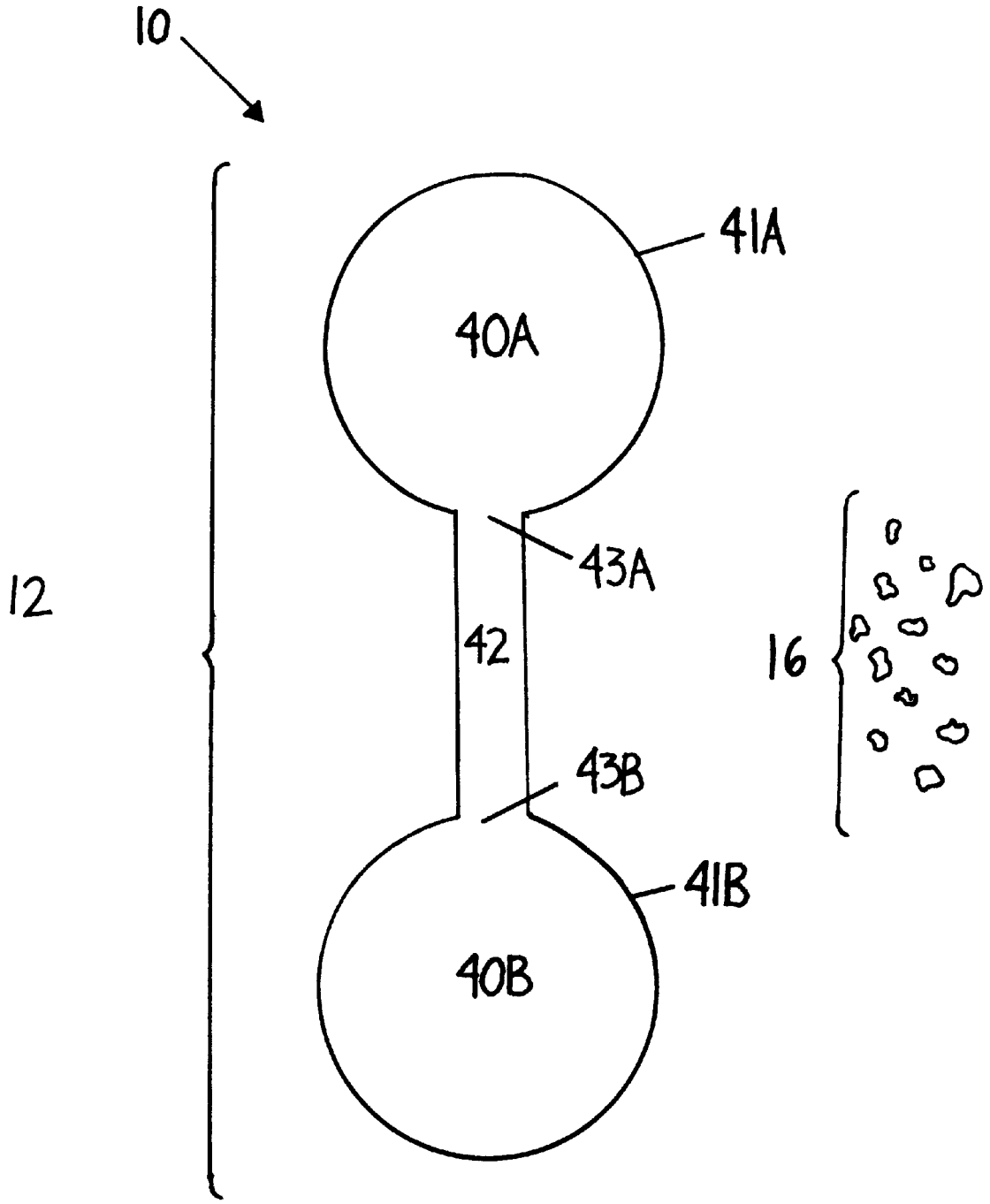
FIG. 6A of the drawings is a schematic representation of an unassembled frameless chair showing, among other things, a unitary outer liner and the adjoining edges of the contiguous members according to the present invention.
Figure 6B:
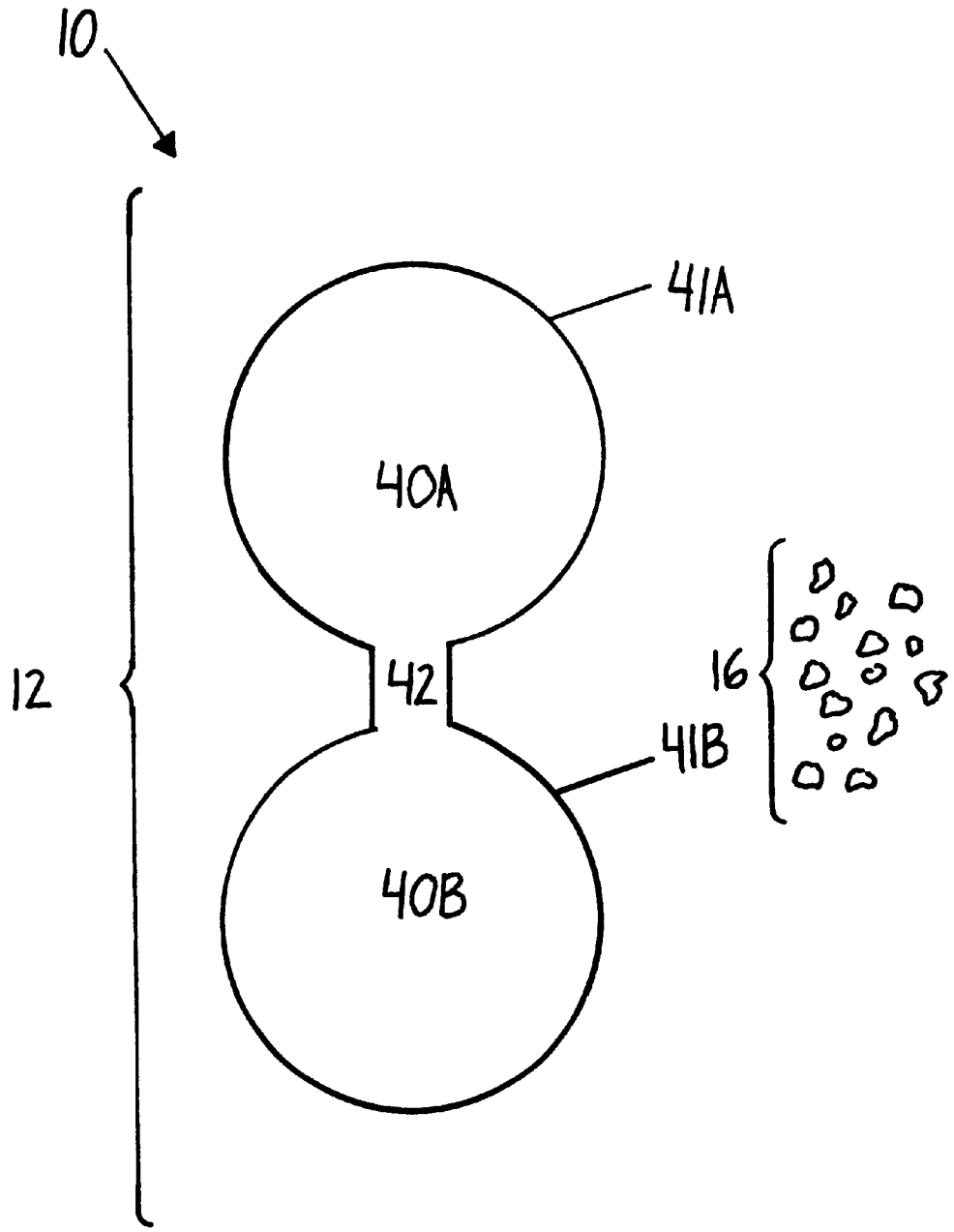
FIG. 6B of the drawings is a schematic representation of an unassembled frameless chair showing, among other things, a unitary outer liner and the adjoining edges of the contiguous members according to the present invention.

A second embodiment of frameless chair 10 is shown in FIG. 6, prior to assembly, as generally comprising outer liner 12 and a plurality of polyurethane foam pieces 16. Although not shown, for each embodiment provided herein, it is contemplated that an inner liner, which is structurally analogous to inner liner 14 or any outer liners 12 disclosed herein, may be included with frameless chair 10. Alternatively, an inner liner may be fabricated in any one of a number of manners known to those having ordinary skill in the art having the present disclosure before them—the only limitation being that the inner liner must comprise a structure and composition which both is retained by the outer liner as well as retains a plurality of polyurethane foam pieces.

Outer liner 12 includes first lobe 40A, second lobe 40B, and member 42. Outer liner 12 is unitary in structure and first and second lobes 40A and 40B, which have substantially circular peripheral geometries, emanate contiguously from member 42, which has a regular or non-regular polygonal peripheral geometry. As is shown in FIG. 6, member 42 may comprise a substantially rectangular geometry. Upon assembly of outer liner 12, first and second lobes 40A and 40B are fused together proximate their peripheral geometries, preferably by sewing. However, any one of a number of fusing techniques known to those having ordinary skill in the art are likewise contemplated for use.

Figure 7:
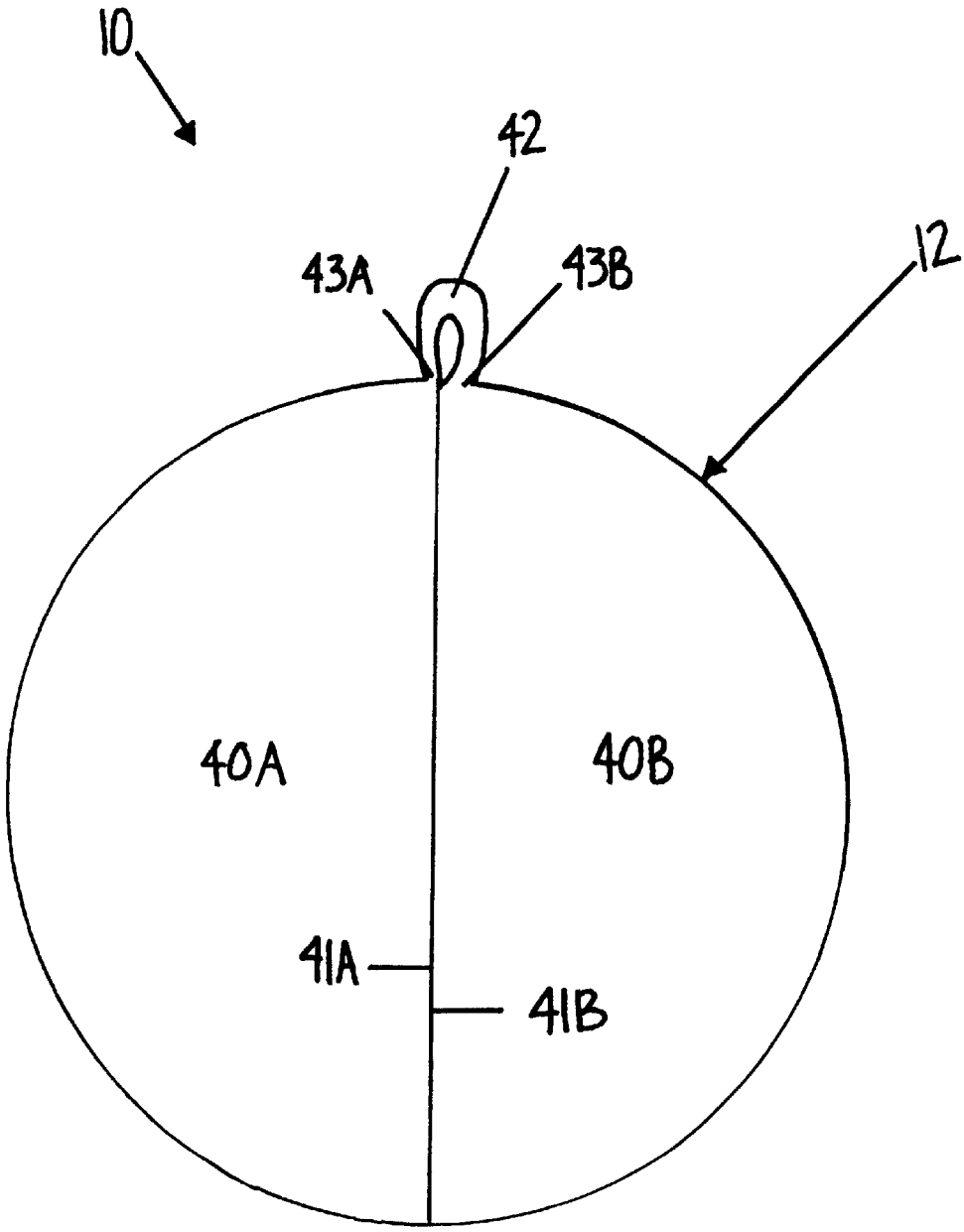
FIG. 7 of the drawings is a schematic representation of an assembled outer liner according to the present invention.

As is shown in FIG. 7, edge 41A of lobe 40A is fused to edge 41B of lobe 40B to, in turn, form outer liner 12, and end 43A of member 42 is fused to end 43B of member 42 to seal outer liner 12 and to, in turn, form a looped handle from member 42. Consequently, the length of member 42 determines the size of the looped handle. Alternatively, although not shown, before fusing end 43A to end 43B, member 42 may be tucked inside outer liner 12 so that no looped handle is present in frameless chair 10.

Although not shown, for each embodiment herein below, it is contemplated that a zipper be associated with outer liner 12 and/or an inner liner and any seams thereon. In addition, the zipper may be treated with an adhesive to enhance the lockability of the zipper and, in turn, substantially prevent it from opening inadvertently.

Lobes 40A and 40B and member 42 of outer liner 12 are preferably sewn together so that the external seams are void of exposed stitching, including seams on the looped handle. The avoidance of exposed stitching is best shown in FIG. 4 and is accomplished by means analogous to what is shown therein and what has been described above. It will be understood that, preferably, all embodiments provided herein may incorporate such stitching in their outer liners, inner liners, and/or handles.

Outer liner 12 is preferably fabricated from a flexible, machine washable material that is at least partially gas permeable so as to allow air to enter and exit the liner when an occupant sits in or departs from the chair. It will be understood that, preferably, all embodiments provided herein may be fabricated from such a material.

Figure 8A:
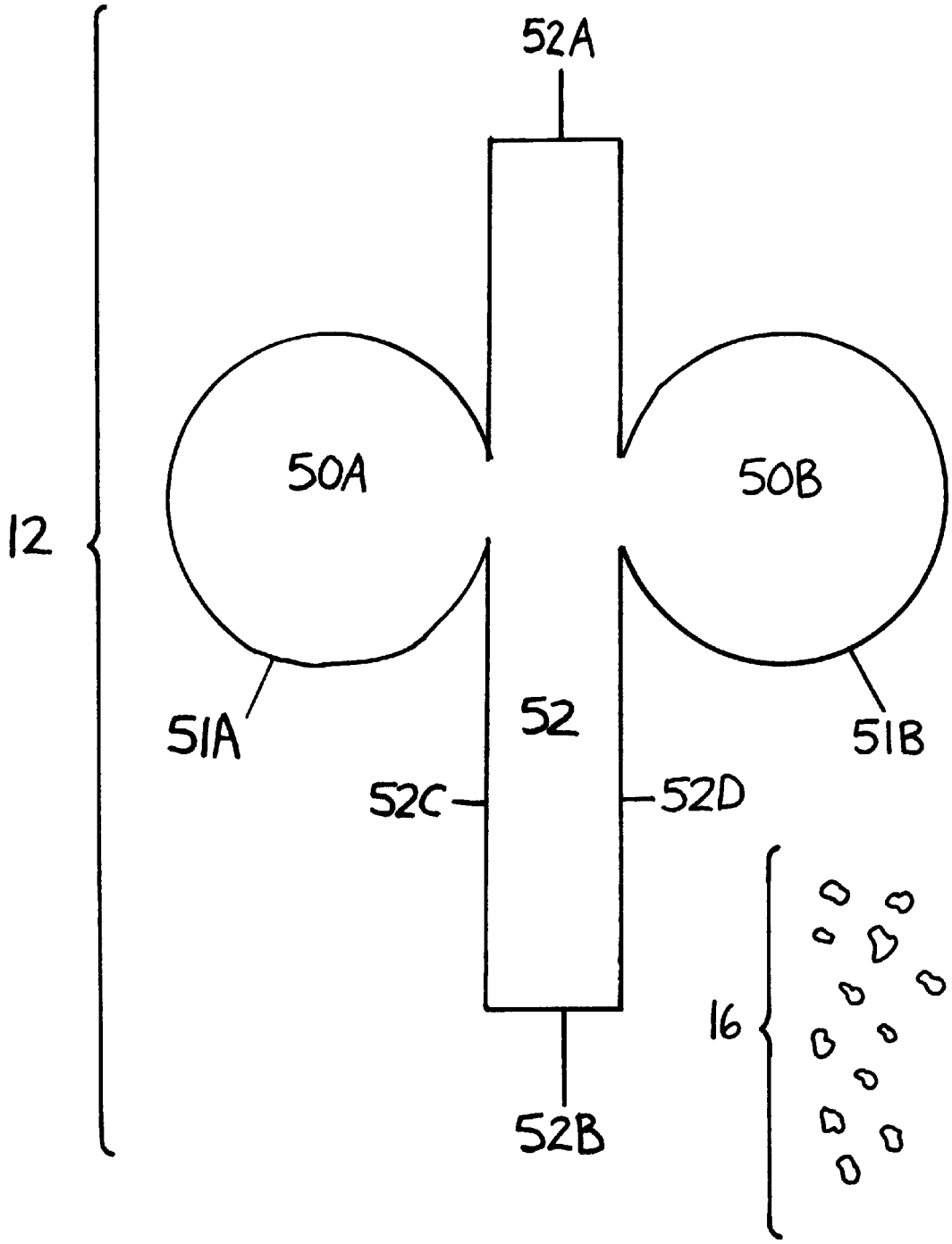
FIG. 8A of the drawings is a schematic representation of an unassembled frameless chair showing, among other things, a unitary outer liner and the adjoining edges of the contiguous members according to the present invention.
Figure 8B:
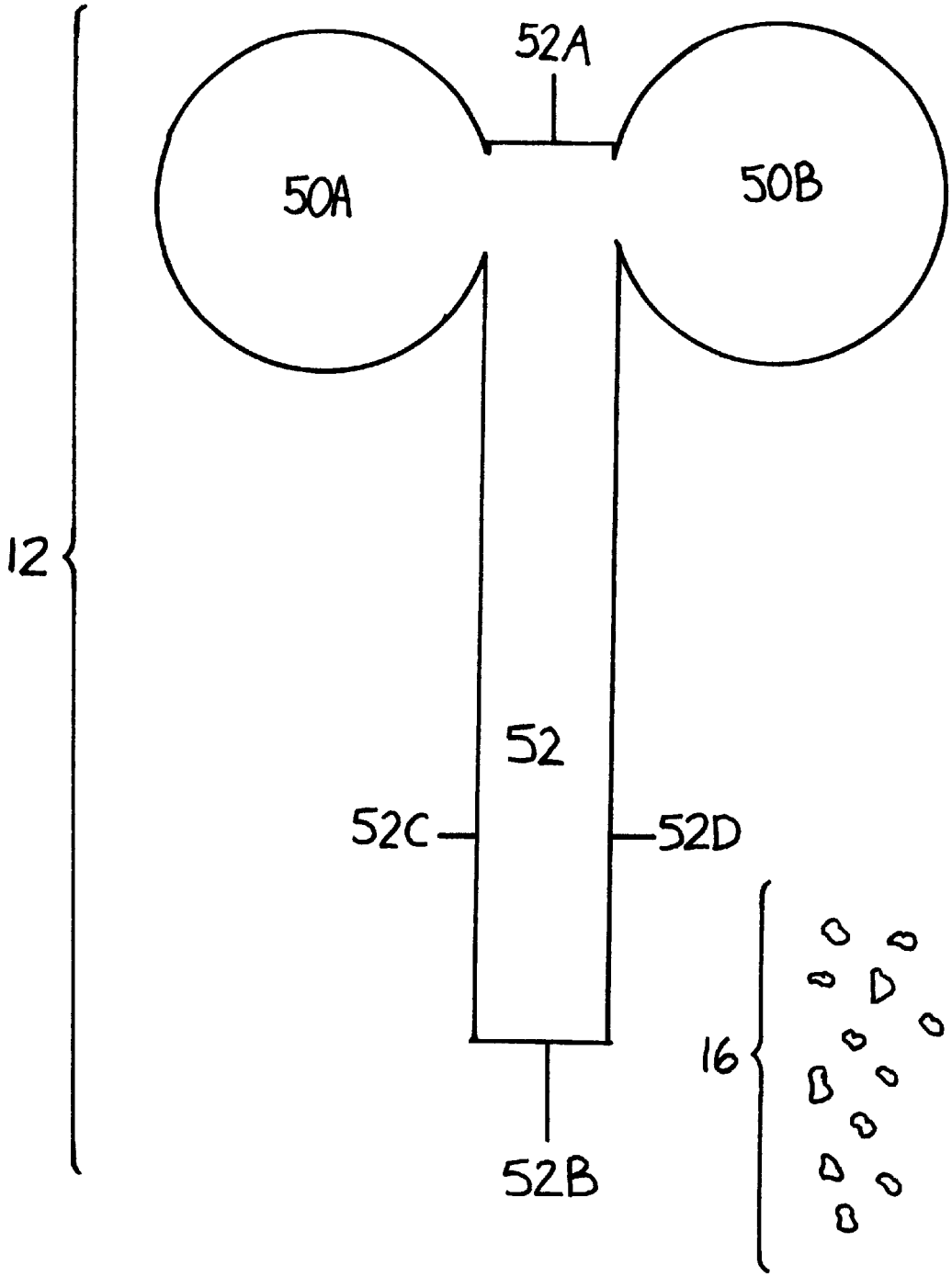
FIG. 8B of the drawings is a schematic representation of an unassembled frameless chair showing, among other things, a unitary outer liner and the adjoining edges of the contiguous members according to the present invention.

A third embodiment of frameless chair 10 is shown in FIG. 8, prior to assembly, as generally comprising outer liner 12 and a plurality of polyurethane foam pieces 16.

Figure 9:
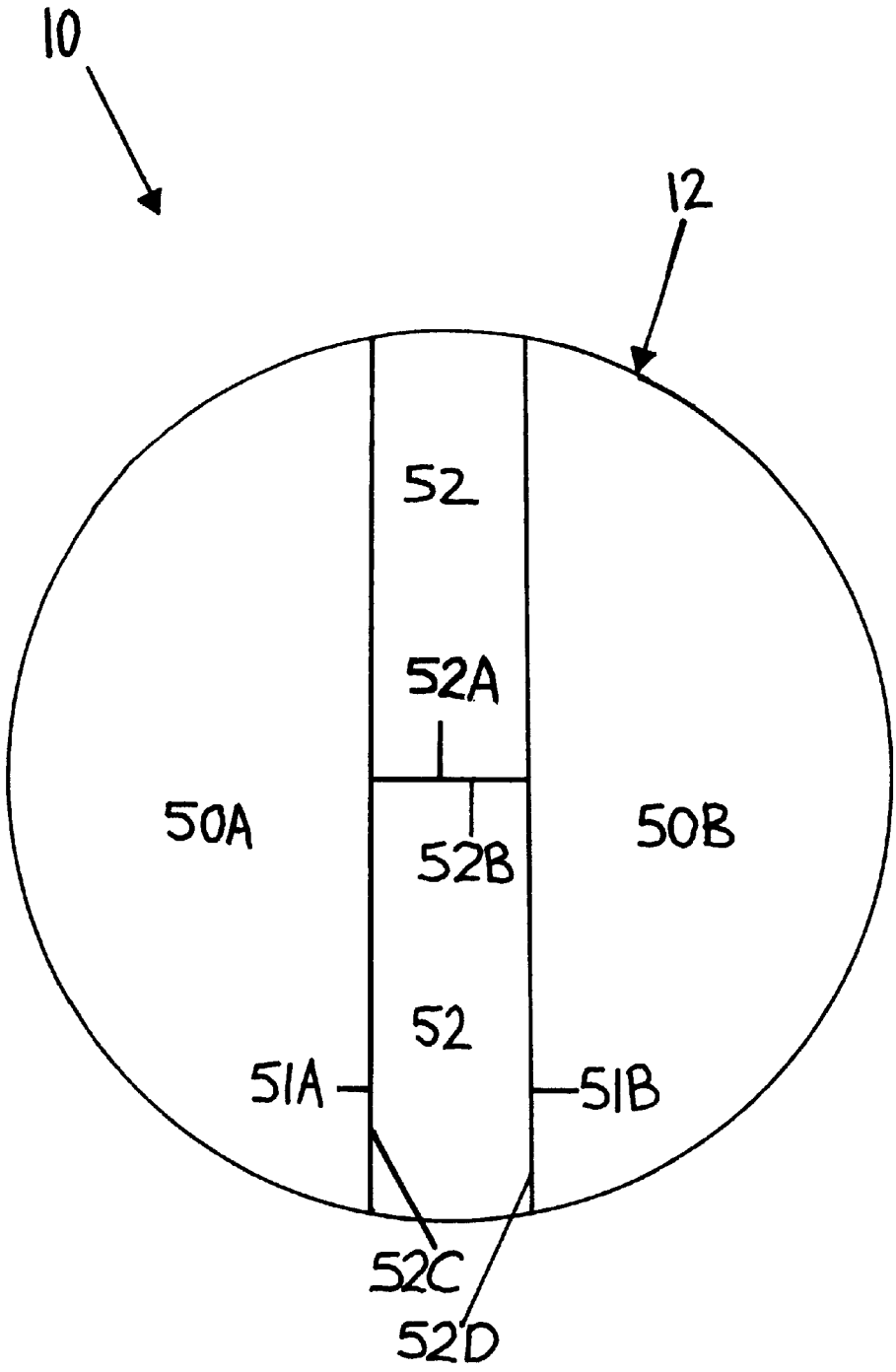
FIG. 9 of the drawings is a schematic representation of an assembled outer liner according to the present invention.
Figure 10A:
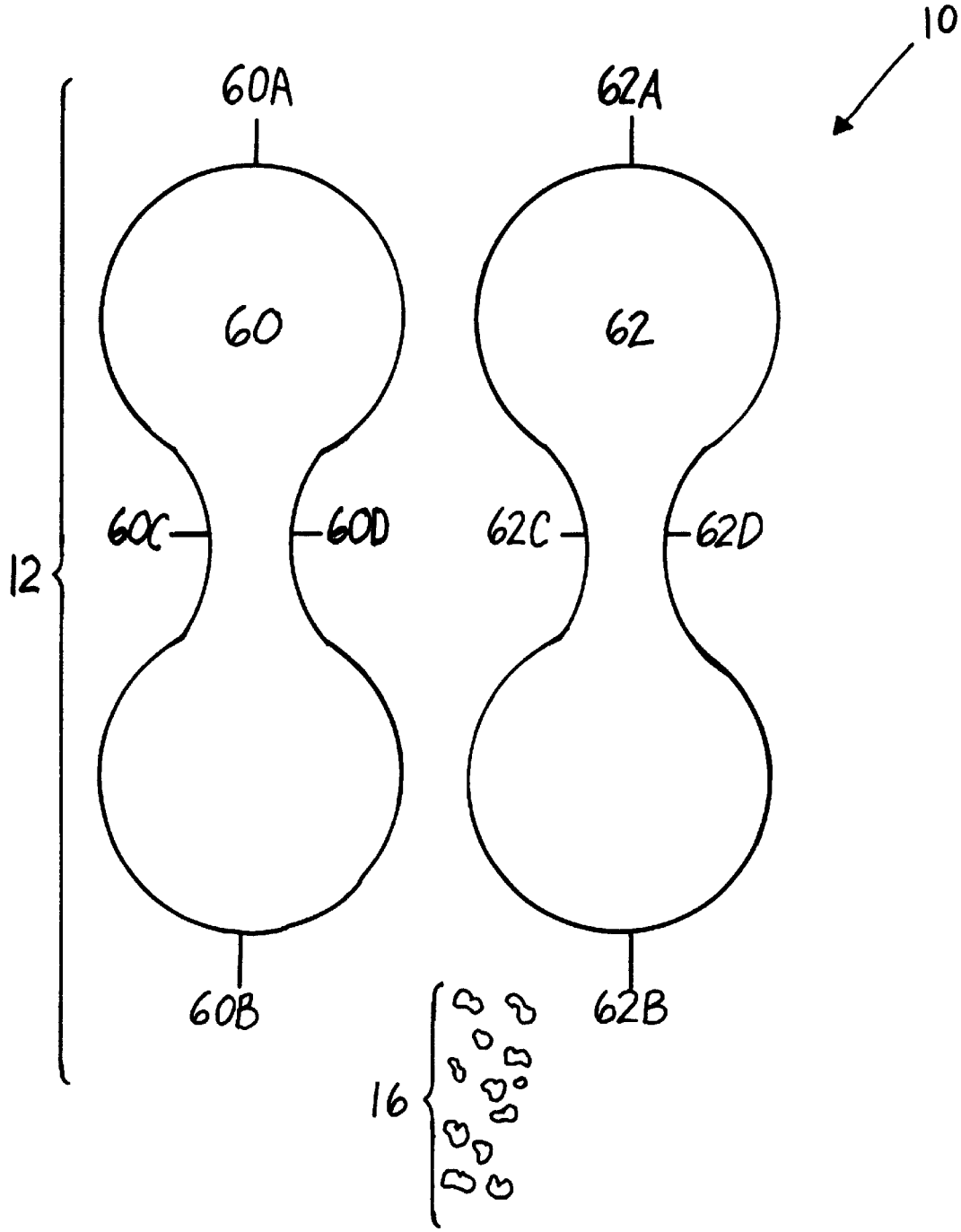
FIG. 10A of the drawings is a schematic representation of an unassembled frameless chair showing, among other things, an outer liner and the adjoining edges of the flexible components according to the present invention.
Figure 10B:
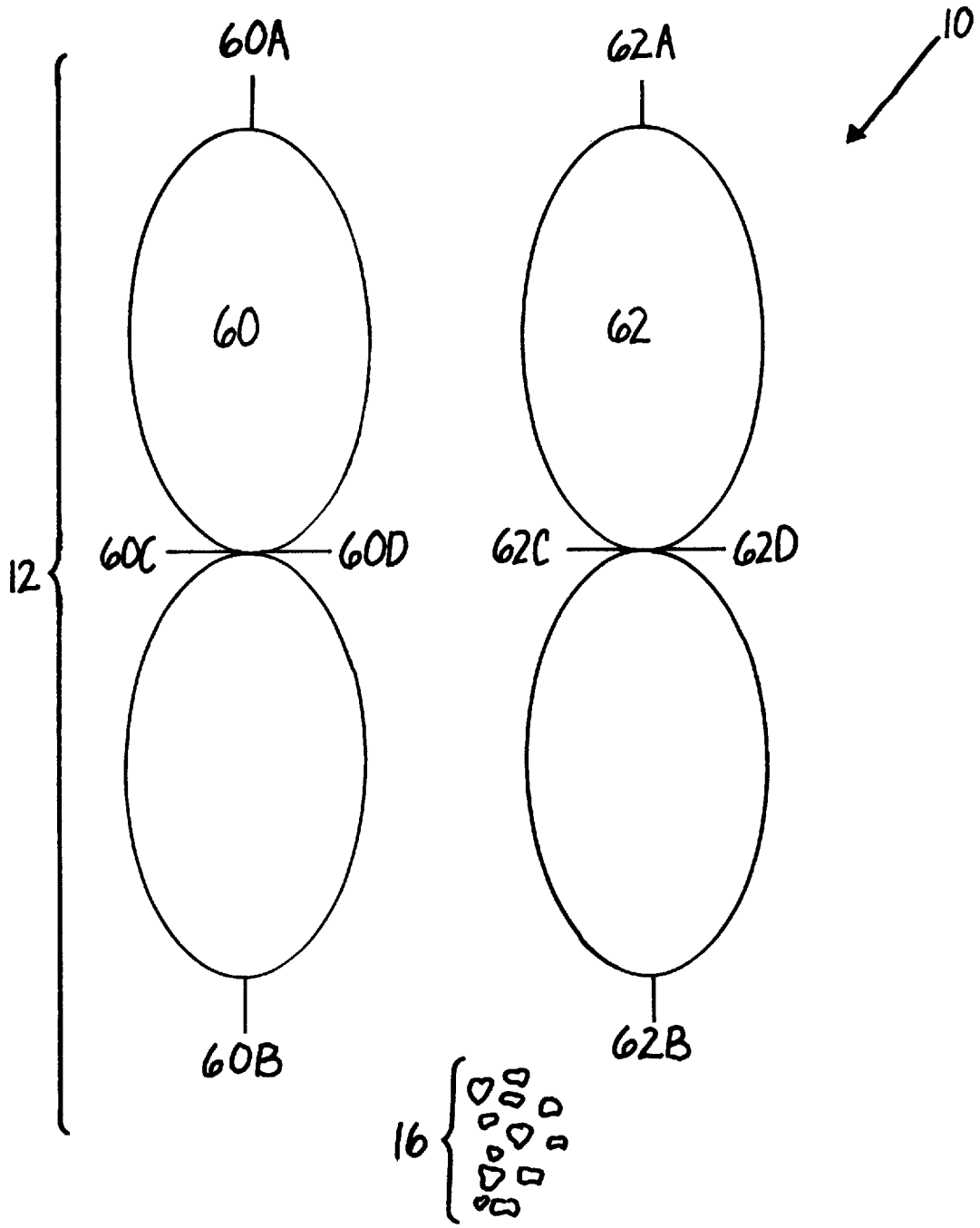
FIG. 10B of the drawings is a schematic representation of an unassembled frameless chair showing, among other things, an outer liner and the adjoining edges of the flexible components according to the present invention.

In this embodiment, outer liner 12 includes first lobe 50A, second lobe 50B, and member 52. Outer liner 12 is structurally unitary and first and second lobes 50A and 50B, which have substantially circular peripheral geometries, emanate contiguously from member 52, which has a regular or non-regular polygonal peripheral geometry. As is shown in FIG. 8, member 52 may comprise a substantially rectangular geometry. Upon assembly of outer liner 12, first and second lobes 50A and 50B and member 52 are fused together proximate their peripheral geometries, preferably by sewing. However, any one of a number of fusing techniques known to those having ordinary skill in the art are likewise contemplated for use. As is shown in FIG. 9, edge 51A of lobe 50A is fused to edge 52C of member 52, and edge 51B of lobe 50B is fused to edge 52D of member 52. Edges 52A and 52B of member 52 are fused together to, in turn, form outer liner 12.

Although not shown, a looped handle may be attached or attachable to frameless chair 10. For example, member 52 may be constructed such that its length permits a portion of member 52 to form a looped handle. It will be understood that, although not shown, all embodiments described herein may comprise a handle.

A fourth embodiment of frameless chair 10 is shown in FIG. 10, prior to assembly, as generally comprising outer liner 12 and a plurality of polyurethane foam pieces 16.

Figure 11:
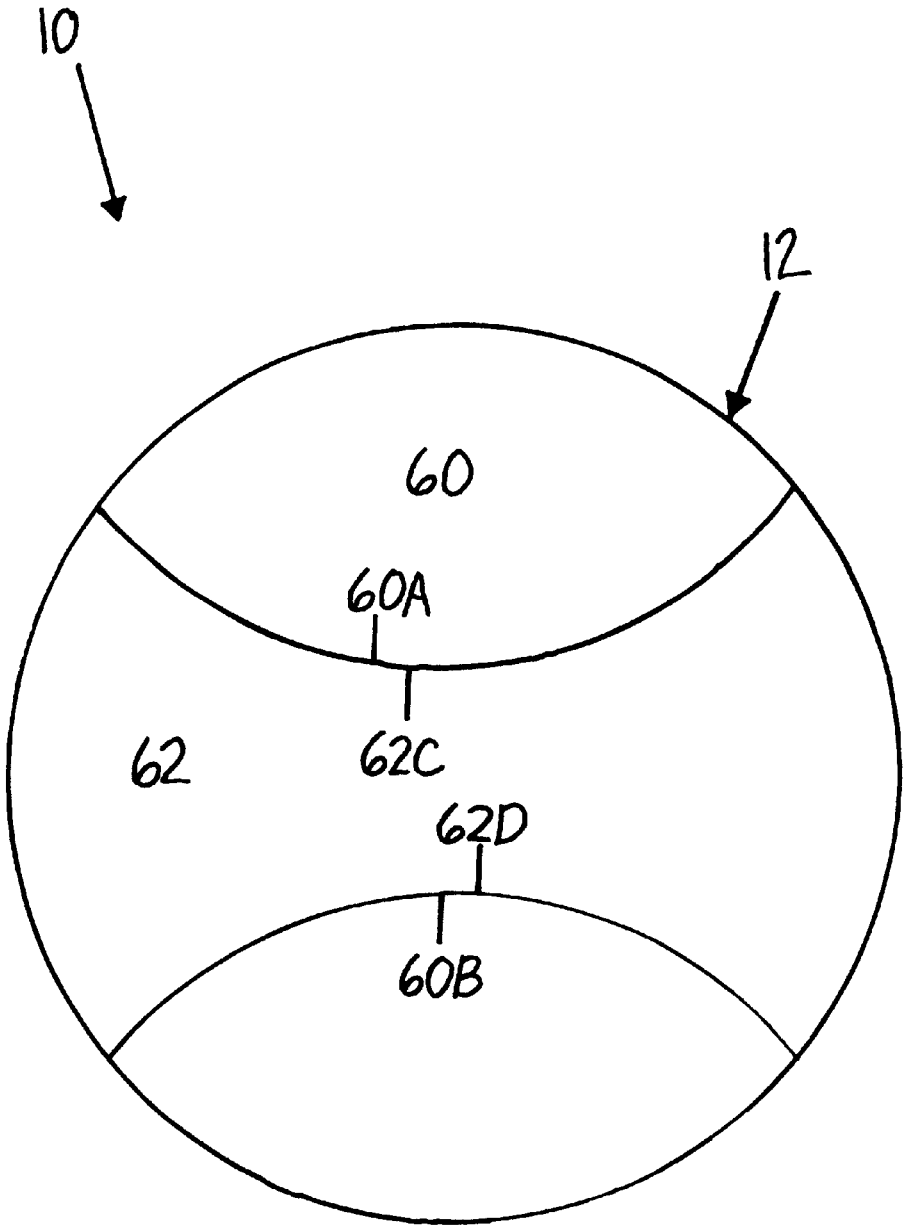
FIG. 11 of the drawings is a schematic representation of an assembled outer liner according to the present invention.

In this embodiment, outer liner 12 includes first member 60 and second member 62. First and second members 60 and 62 have substantially lemniscate peripheral geometries. Regardless of its original meaning, the term "lemniscate" will herein be defined as having a continuous curve generated substantially by the formula: $r^2=a^2\cos 2\theta$, wherein the curve may or may not intersect at a node, and/or wherein the curve may be represented by one of the structures of members 60 or 62 of outer liner 12 provided in FIG. 10A or FIG. 10B. Upon assembly of outer liner 12, first and second members 60 and 62 are fused together proximate their peripheral geometries, preferably by sewing. However, any one of a number of fusing techniques known to those having ordinary skill in the art are likewise contemplated for use. As is shown in FIG. 11, edge 60A is fused to edge 62C, edge 60B is fused to edge 62D, edge 62A is fused to edge 60D, and edge 62B is fused to edge 60C to, in turn, form outer liner 12.

Figure 12:
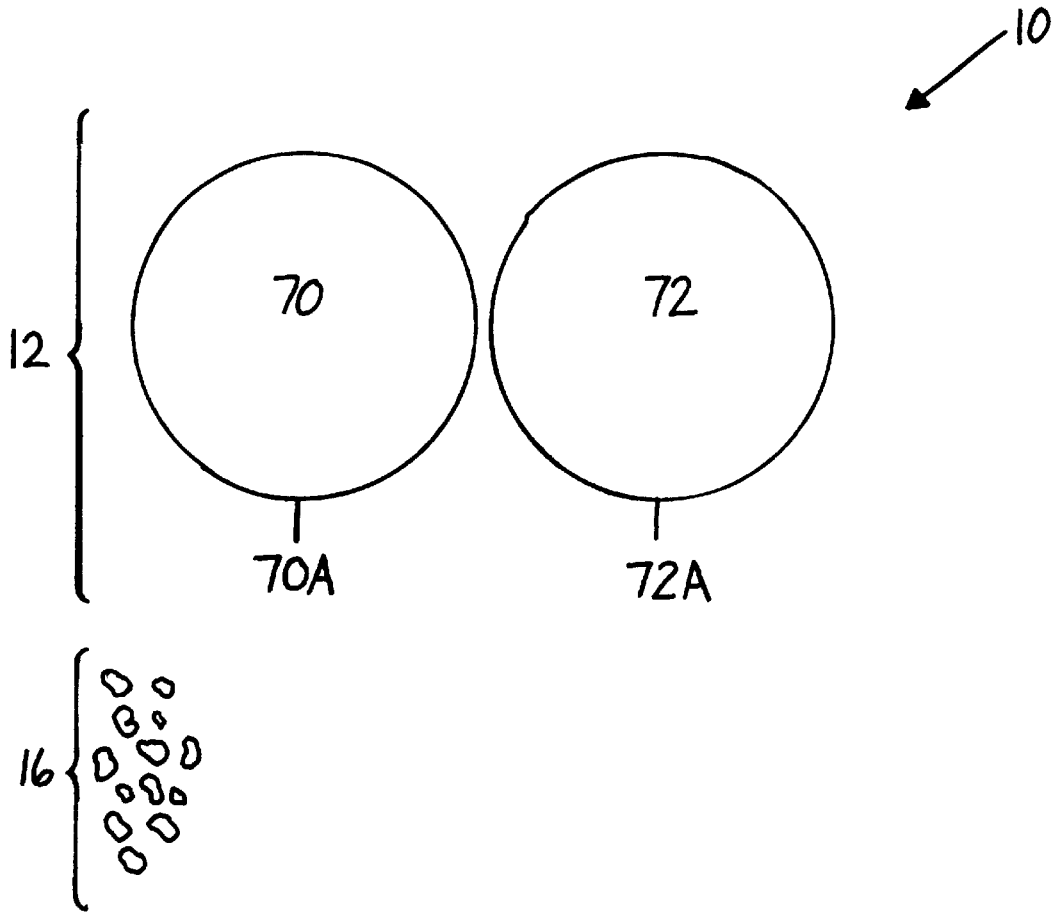
FIG. 12 of the drawings is a schematic representation of an unassembled frameless chair showing, among other things, an outer liner and the adjoining edges of the flexible components according to the present invention.

A fifth embodiment of frameless chair 10 is shown in FIG. 12, prior to assembly, as generally comprising outer liner 12 and a plurality of polyurethane foam pieces 16.

Figure 13:
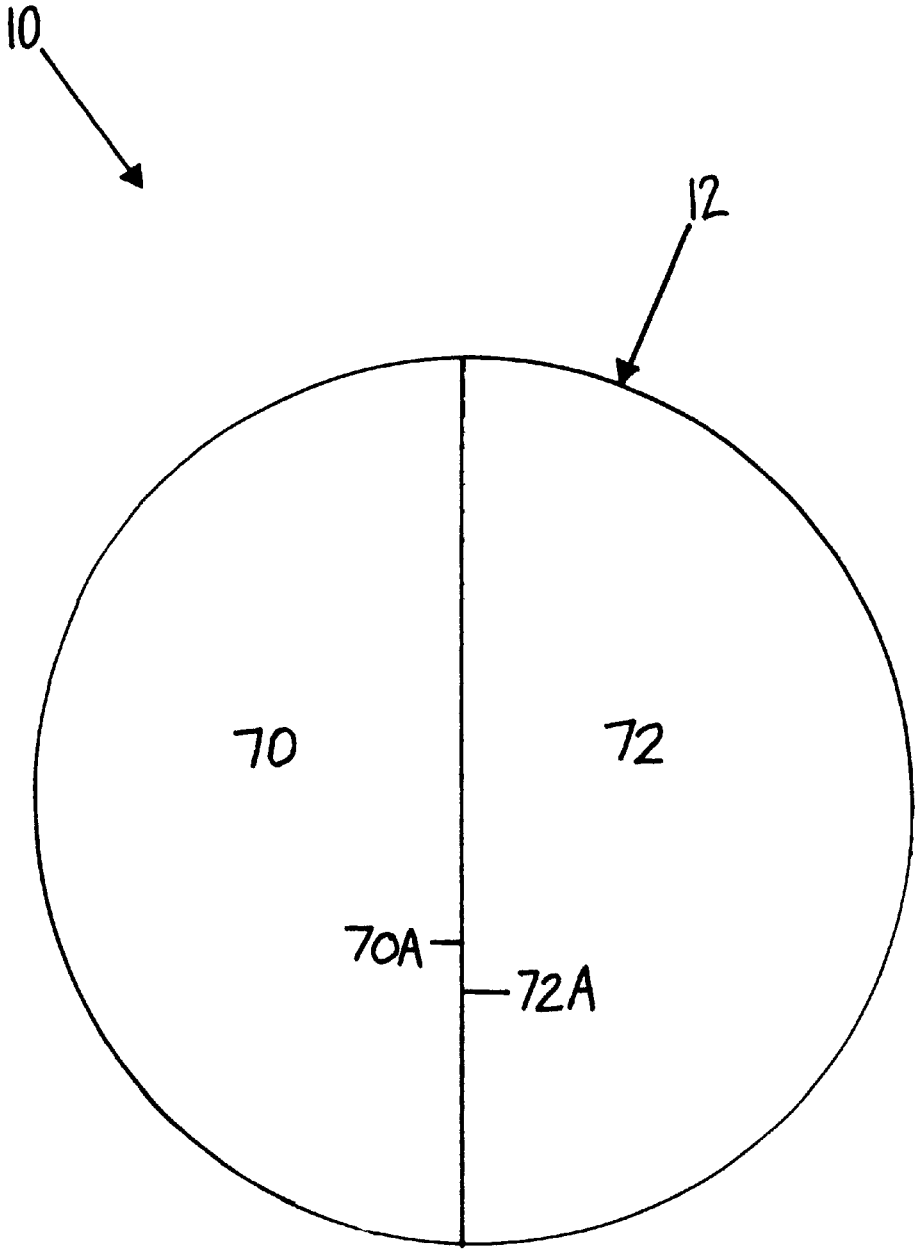
FIG. 13 of the drawings is a schematic representation of an assembled outer liner according to the present invention.

In this embodiment, outer liner 12 includes first member 70 and second member 72. First and second members 70 and 72 have substantially circular peripheral geometries. Upon assembly of outer liner 12, first and second members 70 and 72 are fused together proximate their peripheral geometries, preferably by sewing. However, any one of a number of fusing techniques known to those having ordinary skill in the art are likewise contemplated for use. As is shown in FIG. 13, edge 70A is fused to edge 72A to, in turn, form outer liner 12.

Figure 14:
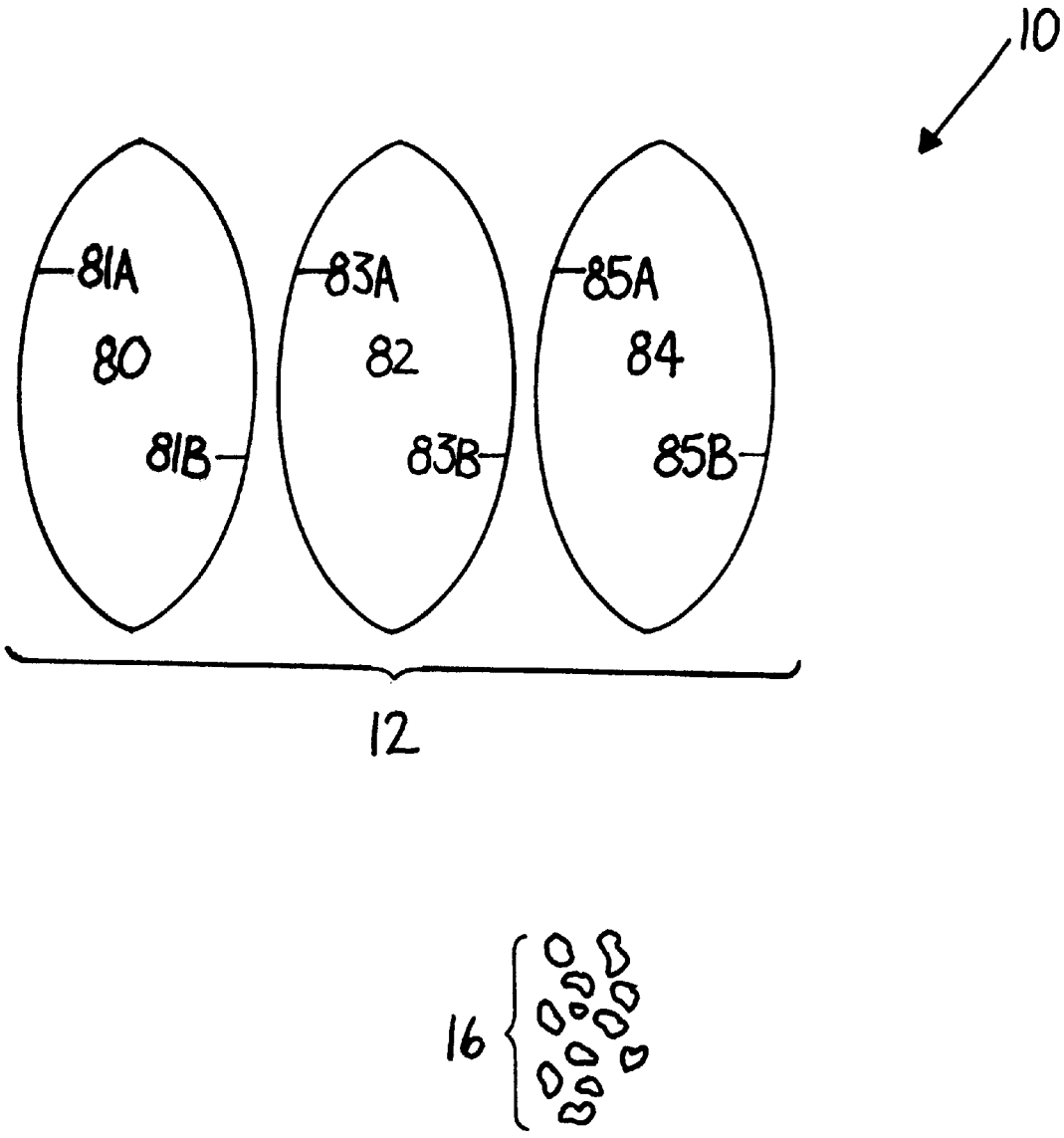
FIG. 14 of the drawings is a schematic representation of an unassembled frameless chair showing, among other things, an outer liner and the adjoining edges of the flexible components according to the present invention.

A sixth embodiment of frameless chair 10 is shown in FIG. 14, prior to assembly, as generally comprising outer liner 12 and a plurality of polyurethane foam pieces 16.

Figure 15:
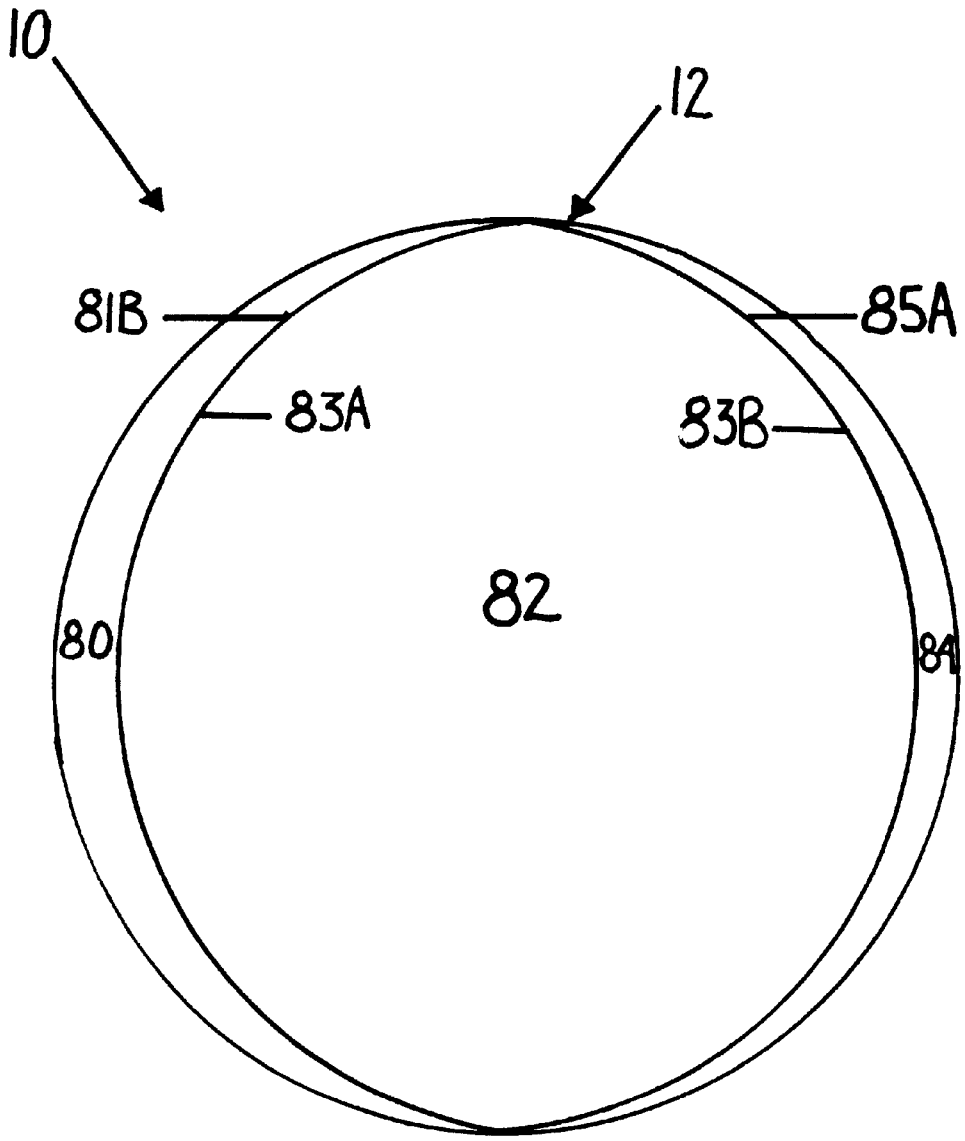
FIG. 15 of the drawings is a schematic representation of an assembled outer liner according to the present invention.

In this embodiment, outer liner 12 includes first member 80, second member 82, and third member 84. First, second, and third members 80, 82, and 84, have substantially biconvex peripheral geometries. Regardless to its original meaning, the term "biconvex" will herein be defined as having a geometrical shape resulting from the intersection of two convex curves, and/or wherein the shape may be represented by one of the structures of members 80, 82, or 84 of outer liner 12 provided in FIG. 14. Upon assembly of outer liner 12, first, second, and third members 80, 82, and 84 are fused together proximate their peripheral geometries, preferably by sewing. However, any one of a number of fusing techniques known to those having ordinary skill in the art are likewise contemplated for use. As is shown in FIG. 15, edge 81B of member 80 is fused to edge 83A of member 82, edge 83B of member 82 is fused to edge 85A of member 84, and edge 85B of member 84 is fused to edge 81A of member 80 to, in turn, form outer liner 12.

Figure 16:
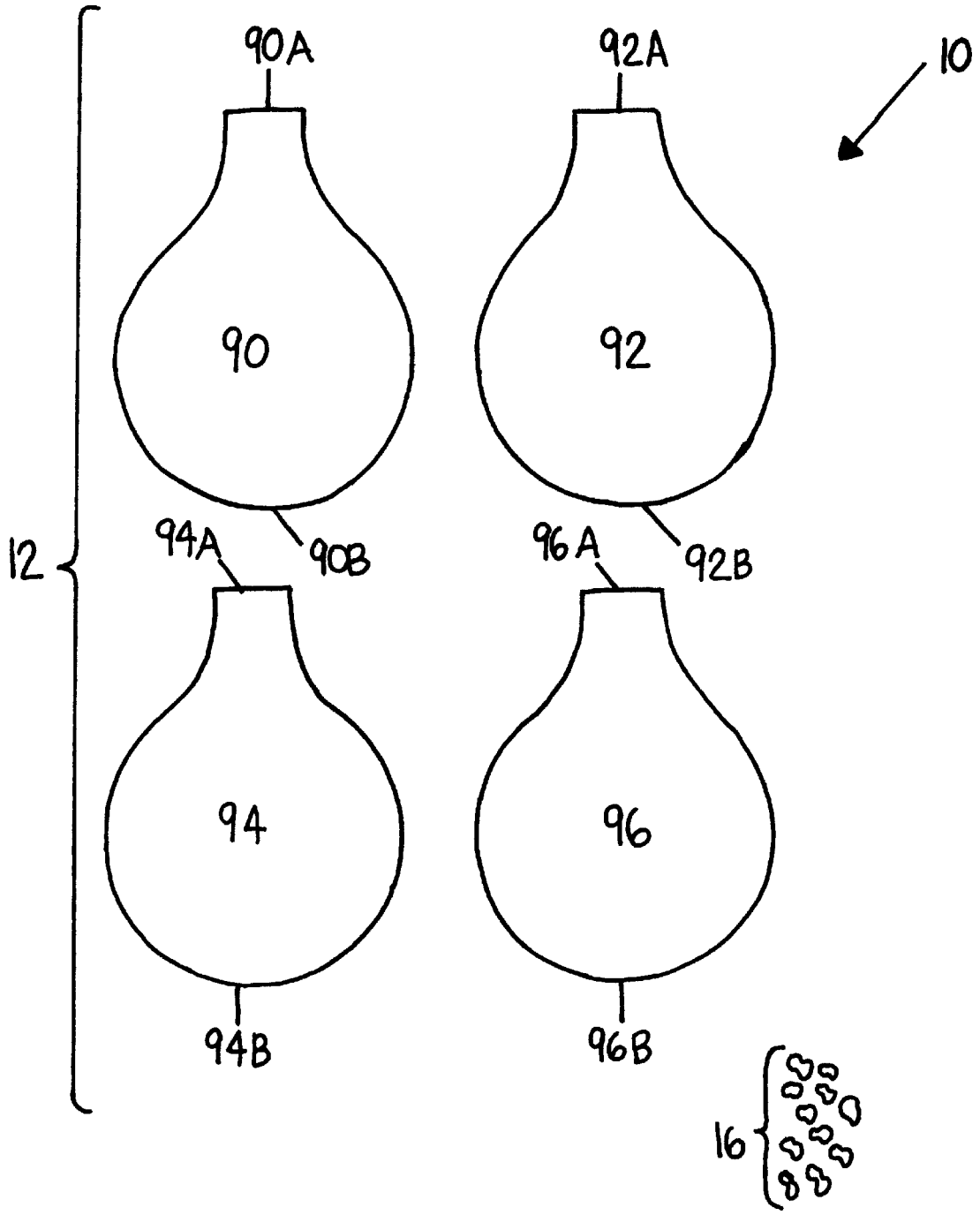
FIG. 16 of the drawings is a schematic representation of an unassembled frameless chair showing, among other things, an outer liner and the adjoining edges of the flexible components according to the present invention.

A seventh embodiment of frameless chair 10 is shown in FIG. 16, prior to assembly, as generally comprising outer liner 12 and a plurality of polyurethane foam pieces 16.

Figure 17:
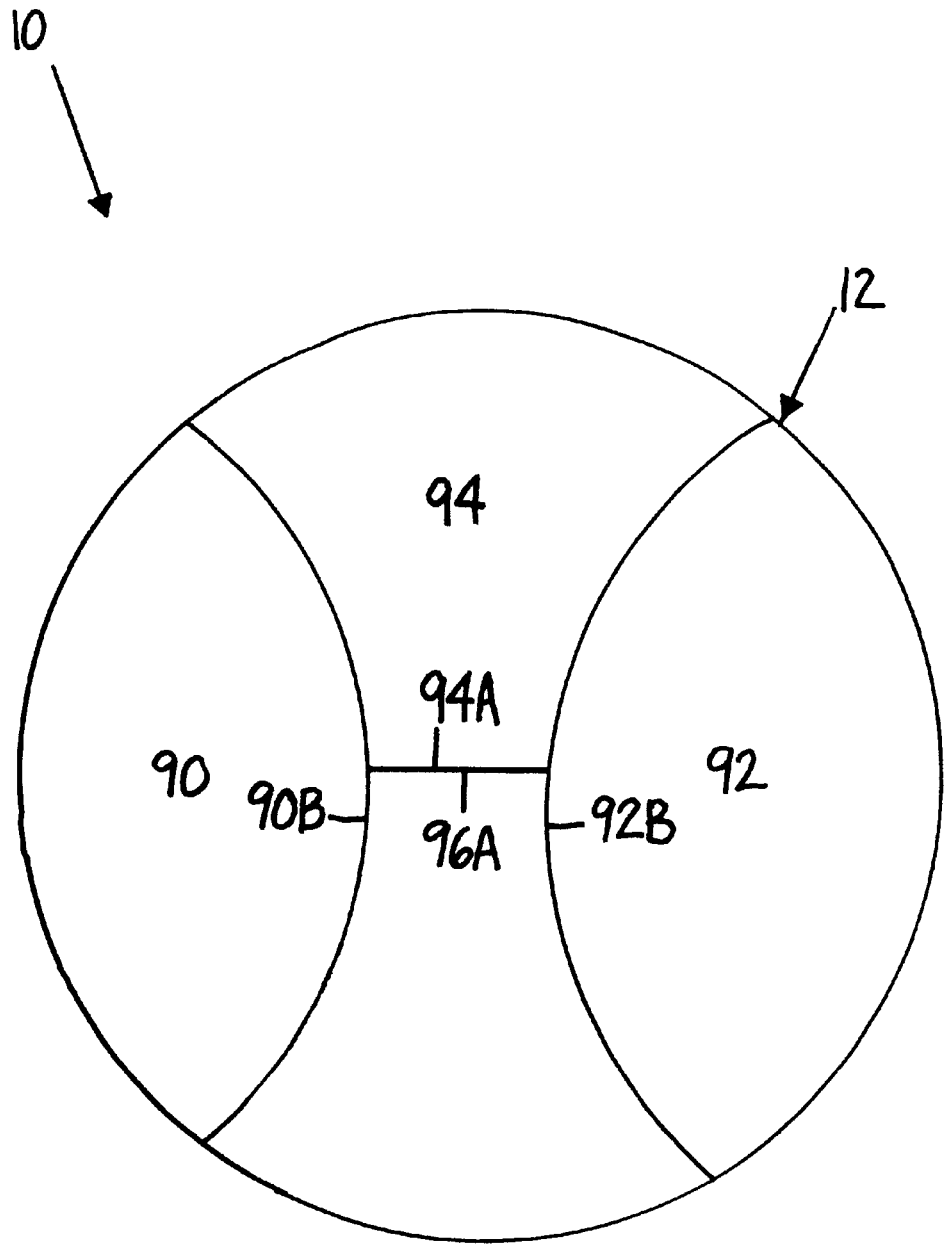
FIG. 17 of the drawings is a schematic representation of an assembled outer liner according to the present invention.

In this embodiment, outer liner 12 includes first member 90, second member 92, third member 94, and fourth member 96. First, second, third, and fourth members 90, 92, 94, and 96 have substantially pyriform peripheral geometries. Regardless to its original meaning, the term "pyriform" will herein be defined as having a geometrical shape resembling a pear, and/or wherein the shape may be represented by one of the structures of members 90, 92, 94, or 96 of outer liner 12 provided in FIG. 16. Upon assembly of outer liner 12, first, second, third, and fourth members 90, 92, 94, and 96 are fused together proximate their peripheral geometries, preferably by sewing. However, any one of a number of fusing techniques known to those having ordinary skill in the art are likewise contemplated for use. As is shown in FIG. 17, edge 94A of member 94 is fused to edge 96A of member 96, which are both proximate edges 90B and 92B of members 90 and 92, respectively, and edge 90A of member 90 is fused to edge 92A of member 92, which are both proximate edges 94B and 96B of members 94 and 96, respectively, to, in turn, form outer liner 12.

Figure 18:
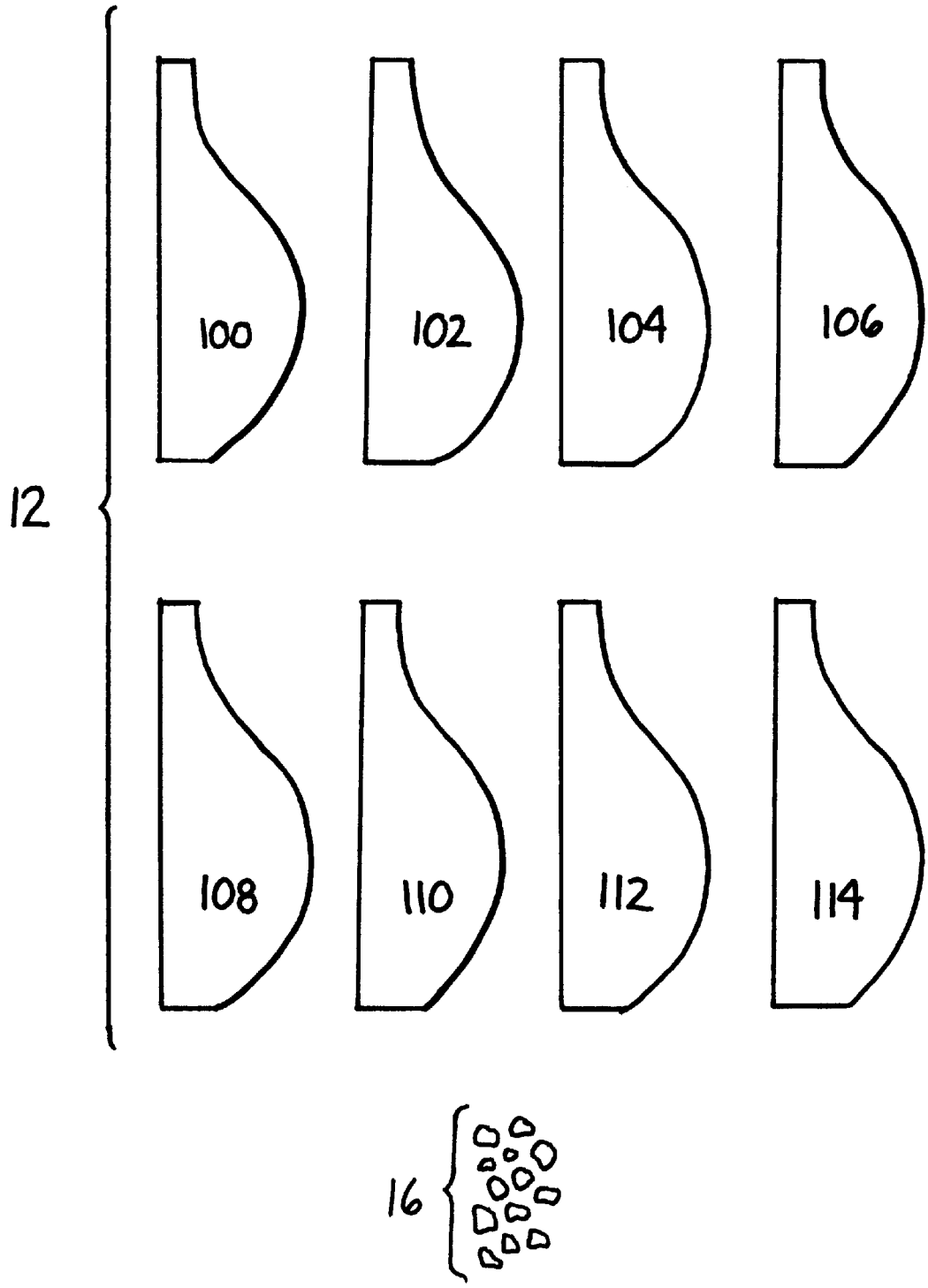
FIG. 18 of the drawings is a schematic representation of an unassembled frameless chair showing, among other things, an outer liner and the adjoining edges of the flexible components according to the present invention.

An eighth embodiment of frameless chair 10 is shown in FIG. 18, prior to assembly, as generally comprising outer liner 12 and a plurality of polyurethane foam pieces 16.

Figure 19:
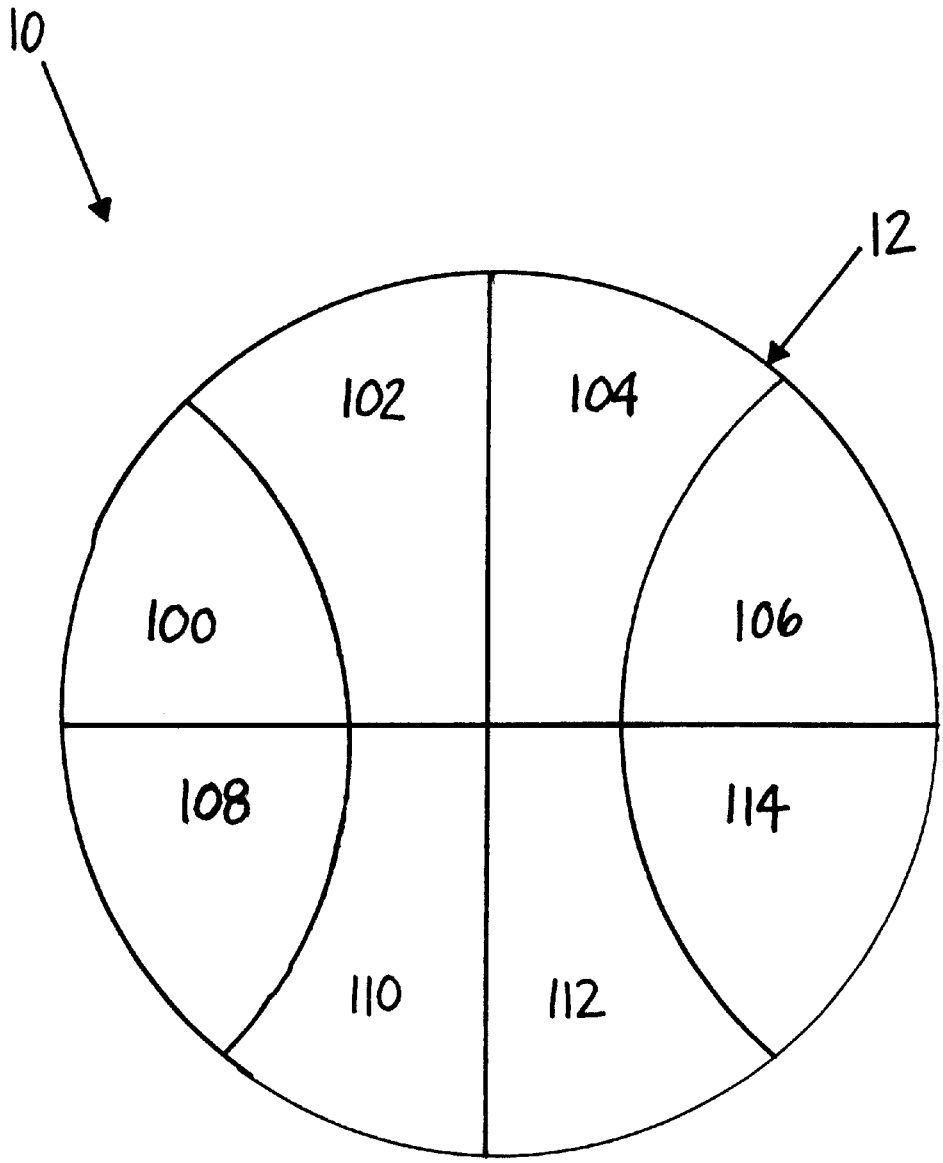
FIG. 19 of the drawings is a schematic representation of an assembled outer liner according to the present invention.

In this embodiment, outer liner 12 includes eight members, referred to as 100, 102, 104, 106, 108, 110, 112, and 114, which have substantially hemipyriform peripheral geometries. Regardless to its original meaning, the term "hemipyriform" will herein be defined as having a geometrical shape resembling the cross-section of a half of a pear, and/or wherein the shape may be represented by one of the structures of members 100, 102, 104, 106, 108, 110, 112, or 114 of outer liner 12 provided in FIG. 18. Upon assembly of outer liner 12, members 100, 102, 104, 106, 108, 110, 112, and 114 are fused together proximate their peripheral geometries, preferably by sewing. However, any one of a number of fusing techniques known to those having ordinary skill in the art are likewise contemplated for use. As is shown in FIG. 19, members 100, 102, 104, 106, 108, 110, 112, and 114 are fused together proximate their peripheral geometries to, in turn, form outer liner 12.

Although not shown, a plurality of embodiments are contemplated in accordance with the present invention such that frameless chair 10 be configured with a substantially spherical geometry upon filling with the plurality of polyurethane foam pieces 16. As such, outer liner 12 may comprise any one of a plurality of members of various shapes and sizes—for example, polygonal, square, rectangular, triangular, arbitrary, and/or curved shapes.

Commercially available polyurethane foam pieces 16 replace conventional inexpensive polystyrene beads because the polystyrene beads are not resiliently compressible. As such, the polystyrene beads are void of any inherent ability to fill out an inner liner back to its original shape after an occupant departs from the chair. Certain species of polyurethane foam, on the other hand, are both compressible and resilient. In particular, it has been found that polyurethane having a density between 1.0 and 4.0 pounds per cubic foot is sufficiently compressible to conform to an occupant's bodily dimensions and sufficiently resilient to fill out the chair one the occupant departs from the same. Moreover, it has been further determined that polyurethane foam having a density of 1.3 to 2.1 pounds per cubic foot is highly desired because it offers the desired resiliency without added weight—an important characteristic for shipping mass quantities of chairs having such polyurethane foam. Although not shown, it is contemplated that the foam pieces may comprise a unitary foam piece which substantially conforms to the outer liner.

Foam pieces 16 can also be impregnated with an organic ester. Impregnation of an organic ester serves at least two purposes. First, the odor of commercially available polyurethane may be initially undesirable to certain humans and/or pets. As such, the organic ester can neutralize the undesired odor with a nominal amount—i.e. a very light spray is sufficient with most esters. Second, due to the relatively amorphous characteristics of the polyurethane foam, the foam can readily absorb household odors that can be neutralized with such an organic ester. Any one of a number of commercially available (Aldrich Chemical Co., Milwaukee, Wis. or readily synthesizable organic esters are contemplated for use, and the combinations of esters are virtually limitless.

Although not shown, certain applications may require that frameless chair 10 be at least water resistant, if not, water impermeable. Several agents for creating a water impermeable bearer on material are commercially known and treatment of any and/or all of the components of frameless chair 10 are contemplated. For illustrative purposes only, such water impermeable agents include polymeric or long chain fluorocarbons and silane and siloxane based polymers. Of course, several other agents known to those having ordinary skill in the art are likewise contemplated for use.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A frameless chair, comprising:

an outer liner, wherein the outer liner is at least partially gas permeable, and further wherein the outer liner comprises:

a first flexible component having a substantially lemniscate peripheral geometry; and a second flexible component having a substantially lemniscate peripheral geometry, wherein the first flexible component is secured to the second flexible component to, in turn, form a substantially spherical, continuous and enclosed outer liner; and a plurality of polyurethane foam pieces retained within the outer liner of the frameless chair.

2. The frameless chair according to claim 1, further comprising an inner liner positioned within the outer liner, wherein the plurality of polyurethane pieces are retained within the inner liner.

3. The frameless chair according to claim 1, wherein the density of the polyurethane foam pieces ranges from between approximately 1.0 and approximately 4.0 pounds per cubic foot.

4. The frameless chair according to claim 1, wherein the outer liner includes at least one seam having an outer surface and an inner surface, wherein the outer surface of the seam is void of any exposed stitching.

* * * * *

UNITED STATES PATENT AND TRADEMARK OFFICE

CERTIFICATE OF CORRECTION

PATENT NO. : 6,732,391 B2
APPLICATION NO. : 09/973416
DATED : May 11, 2004
INVENTOR(S) : George, II et al.

It is certified that error appears in the above-identified patent and that said Letters Patent is hereby corrected as shown below:

Title Page, Item (12), "George, II" should read --George, II et al.--.

Title Page, Item (75), should read:

--Inventors: Daniel C. George, II, Grand Rapids, MI (US); Matthew Jung, Ada, MI (US)--.

Signed and Sealed this
Fourteenth Day of April, 2015

Michelle K. Lee

Michelle K. Lee
*Director of the United States Patent and Trademark Office*